United States Patent [19]

Ostler

[11] 4,015,837

[45] Apr. 5, 1977

[54] METHOD AND APPARATUS FOR INSERTING SUPPLEMENTS INTO ROTARY PRESS PRODUCTS

[75] Inventor: Erwin Ostler, Augsburg, Germany

[73] Assignee: Hier. Muhleberger KG, Augsburg, Germany

[22] Filed: Apr. 2, 1976

[21] Appl. No.: 672,912

[30] Foreign Application Priority Data

Apr. 25, 1975 Germany ..... 2518336

[52] U.S. Cl. ..... 270/58

[51] Int. Cl.[2] ..... B65H 39/02

[58] Field of Search ..... 270/7, 11, 17, 58, 41, 270/44, 48, 51, 52, 32; 271/DIG. 3, 18.1, 193; 101/382 MV

[56] References Cited

UNITED STATES PATENTS 2,600,284 6/1952 Tranter ..... 270/11

*Primary Examiner*—Edgar S. Burr
*Assistant Examiner*—A. Heinz
*Attorney, Agent, or Firm*—Pollock, Vande Sande & Priddy

[57] ABSTRACT

A rotary press product such as a newspaper is printed by continuously running one or more paper webs through printing rolls, and supplements are inserted into the product while the webs are running by applying an electrostatic charge to the surface of the running web after the web has been printed, delivering a supplement to the charged surface for electrostatic adhesion thereto, folding the web with the supplement adhering thereto, and then discharging any residual electrostatic charge from the folded product.

14 Claims, 1 Drawing Figure

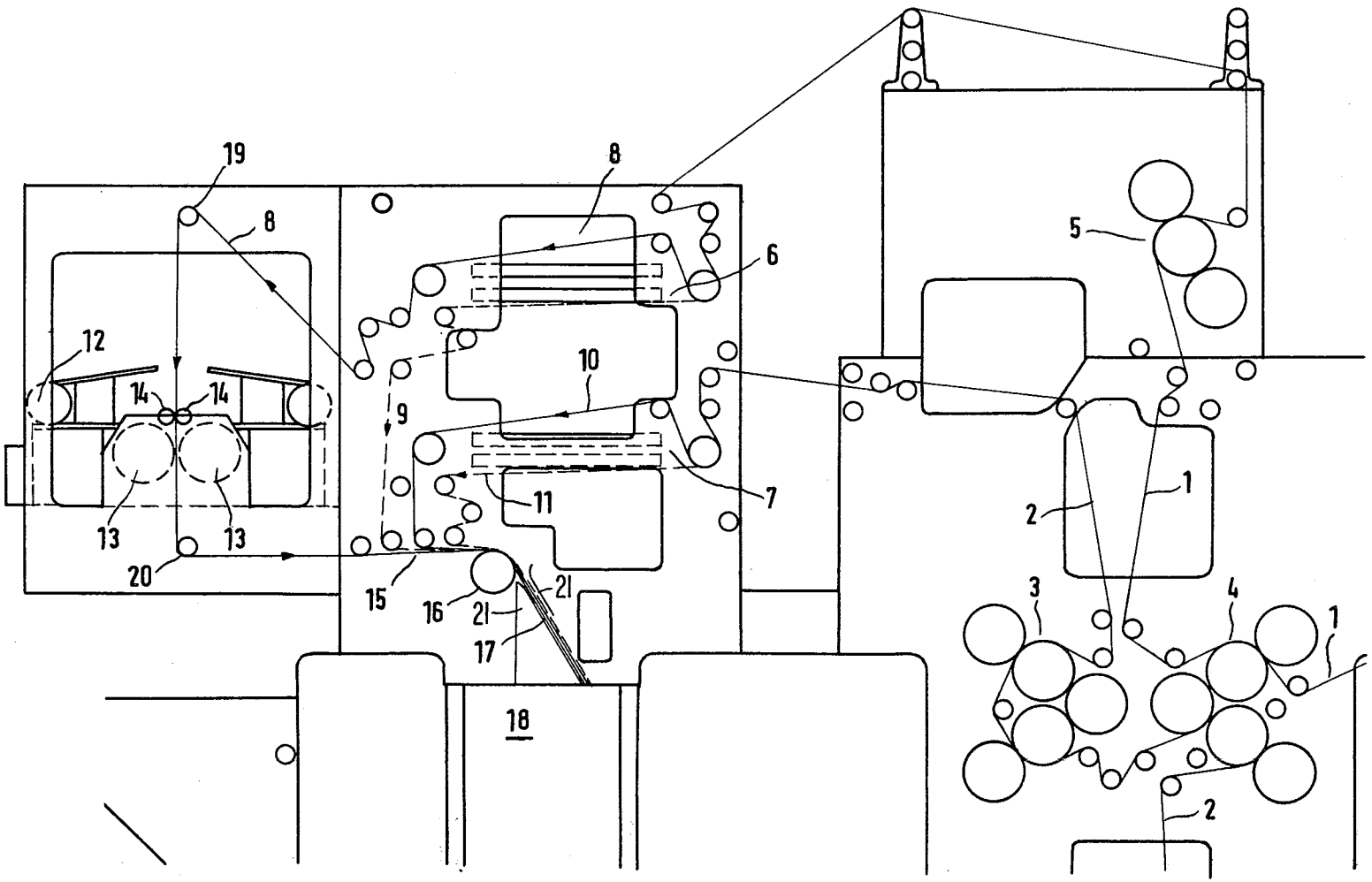
1
2
3
4
5
6
7
8
9
10
11
12
13
14
15
16
17
18
19
20
21

METHOD AND APPARATUS FOR INSERTING SUPPLEMENTS INTO ROTARY PRESS PRODUCTS

The present invention relates to a method of inserting supplements into rotary press products such as newspapers, and to an apparatus for the practical application of such a method.

It has been impossible heretofore to insert supplements into rolls of paper while the paper is running on a press and prior to being folded. Such insertion has normally been accomplished in a separate operation performed after the rotary press product was finished and had emerged from the folding machine, with the procedure involving opening up the rotary press product (for example a newspaper) at its second fold, and inserting the supplement so that the supplement rests loosely in the middle of the newspaper. The supplement, in such an arrangement can be attached only by the use of glue or staples.

In contrast to the foregoing, the present invention solves the problem of how to insert supplements into rolls of paper which are running, prior to the paper being folded. This is accomplished by electrostatically charging the supplements in a polarity which is opposite to the charge polarity of the paper roll so that the charged supplement can be applied to and will adhere to the roll paper in the press while the press is still running. In order to insure a secure adhesion of the supplements to the roll of paper, the static potential of the paper roll should be greater than the static potential of the supplements. Any static electricity still remaining after the folding operation can be eliminated easily after that folding operation, e.g., by causing the folded product to make contact with a grounded discharging electrode at the output end of the folding apparatus.

The apparatus of the present invention, used to effect the practical application of the aforementioned method comprises a delivery device for the transfer of the supplements, said device being located upstream of, or in front of, the folding apparatus, and at least one high-voltage electrode which is arranged in front of, i.e., upstream of, said delivery device and which is in contact with the paper roll. For purposes of the present invention a paper roll can be defined as any roll of paper which is either blank or printed on one or both sides. This includes, for example, continuously running blank forms which are to be folded into a zigzag shape and into which are to be inserted, for example, carbon paper in random order.

The invention will now be explained in greater detail by reference to the accompanying drawing, the single FIGURE of which depicts in side view a portion of a rotary press utilizing the arrangement of the present invention.

Referring to the drawing, two webs of paper 1, 2 respectively coming from their own supply rolls, are fed into printing units 3, 4. Each web of paper 1, 2 is printed in these two printing units 3, 4 on both sides. Web 1 then passes through another printing unit 5 and reaches, in the same manner as paper web 2, turn-over rods 6, 7. Prior to this step, each paper web is cut by cutting cylinders, with web 1 being divided into paper webs 8, 9 and web 2 being divided into webs 10, 11. All four paper webs 8, 9, 10, 11 are conducted past guide spindles 15 in such manner that they join each other at a feed hopper cylinder 16. The four combined webs of paper then pass from the feed hopper cylinder 16 to the folding hopper 17 and from there into the folding apparatus 18 wherein the paper webs are folded and separated. As a result, a finished rotary press product emerges from the folding apparatus 18.

In the example shown in the drawings, it is possible to provide one or both sides of the paper web 8 with supplements, the so-called plano-sheets, in the manner described below.

The paper web 8, upon leaving the cutting cylinder, is guided past a spindle 19 and passes from there through two rod-shaped electrodes 14, respectively arranged adjacent both sides of the paper web 8. Next to the two electrodes 14 there are placed two delivery rollers 13, with the paper web 8 passing through these rollers. An additional guide spindle 20 then directs the paper web 8 to the guide spindles 15 and thus to the feed hopper cylinder 16.

The supplements to be inserted are fed to the delivery rollers 13 and will reach from there the running paper web 8. Adhesion of the supplements to the paper web results from the fact that the paper web is charged electrostatically by the electrodes 14 prior to the attachment of the supplements. Preferably, the supplements are also charged electrostatically prior to their attachment to the running paper web, namely at a charge potential which is opposite in polarity to the potential in the paper web generated by the electrodes 14. In order to insure that the opposite polarity charges of the paper web and supplement will not cancel each other, the magnitude of the potential to which the paper web is charged should be greater than the magnitude of the charge potential of the supplements, so that a static potential will remain after passage of the paper web 8 through the delivery rollers 13, to an extent sufficient to guarantee the adhesion of the supplements to the paper web 8. This remaining charge potential can be eliminated, after the folding operation, by passing the folded product over a grounded discharge electrode positioned adjacent the output end of the folding apparatus.

The supplements can be fed to the delivery rollers 13 in various manners. The practical example illustrated in the drawing utilizes cylindrical stacking applicators 12 which transfer the supplements cyclically to the delivery rollers 13. The stacking applicators 12 are electronically controlled and are equipped with applicator markers. The two applicators 12 are driven by the rotary press and are mounted in such manner that the applicators can be moved by one fourth of the paper roll width. This movability makes it feasible to process four- or two-page supplements always at the center of the applicator. The electronic control of the applicators insures the continuous feed of the supplements even in case of varying printing press speeds.

The diameter of the delivery rollers 13 is preferably identical to the diameters of the printing cylinders in the printing units 3, 4, 5. The delivery rollers are equipped with a clawfeed system which insures a precise transfer of the sheets to the running paper web 8. The symmetrical design makes it possible to feed supplements to the front side as well as to the back-printing side of the paper web. The paper web 8, carrying the fixed and adhering supplements, is then conducted to the feed hopper cylinder 16 by way of the above-mentioned guide spindles. It is possible to install contact blades 21 between the feed hopper cylinder and the folding hopper in order to positively prevent a stripping-off of the supplements.

Using an eight-page rotary press product as an example, the following possibilities of placing the supplements exist: large-sized folded sheets can be placed between pages 2, 3 and 6, 7; large-sized inserted sheets can be placed between pages 4, 5 and possibly between pages 2, 3 and 6,7; large-sized additional sheets can be placed between pages 2, 3 and 4, 5 and 6, 7; and standard-sized supplements can be included in the form of two or multi-pages.

Having thus descirbed my invention, I claim:

1. The method of inserting supplements into a rotary press product wherein said product is produced by continuously running at least one elongated paper web from a supply roll through printing rolls, comprising the steps of applying an electrostatic charge to the surface of said running web subsequent to passage of the web through said printing rolls, delivering a series of supplements sequentially and in face-to-face relation to the charged running surface of said web for electrostatic adhesion of said supplements to said web while said web is still running, and thereafter folding successive portions of said web while said supplements are electrostatically adhered thereto to form at the conclusion of said folding step, folded rotary press products each of which has one of said supplements inserted therein.

2. The method of claim 1 wherein said method includes the step of electrostatically charging each of said supplements prior to said delivering step.

3. The method of claim 2 wherein said charging steps are so performed that the charge polarities of said web and of said supplements are opposite to one another.

4. The method of claim 3 wherein said charging steps are so performed that the magnitude of the charge applied to said running web exceeds the magnitude of the charge applied to each of said supplements.

5. The method of claim 1 including the step of eliminating static charges remaining on said web and supplements subsequent to said folding step.

6. The method of claim 1 wherein said folding step is performed by a folding apparatus, said delivering step being performed by at least one supplement delivery apparatus located adjacent to and upstream of said folding apparatus, and said charging step being performed by at least one high-voltage electrode in contact with said running web at a location upstream of said delivery apparatus.

7. The method of claim 6 wherein said delivering step is performed by a pair of said supplement delivery apparatuses located respectively adjacent opposite sides of said running web, said charging step being performed by a pair of said high-voltage electrodes located in contact with opposite sides of said running web respectively.

8. The method of claim 6 including the step of mechanically inhibiting separation of supplements from said running web in the region between said delivery apparatus and said folding apparatus, said separation inhibiting step being performed by guiding contact blades located in said region.

9. The method of claim 6 including the step of eliminating residual electrostatic charges from said folded rotary press products subsequent to said folding step, said charge eliminating step being performed by a discharging electrode which contacts each of said folded products adjacent the output end of said folding apparatus.

10. The method of claim 6 wherein said delivery apparatus comprises a supplement applicator and a cooperating delivery roller.

11. The method of claim 10 wherein said supplement applicator comprises a cylindrical stacking applicator.

12. The method of claim 10 wherein said applicator is mounted for movement transversely relative to said delivery roller.

13. The method of claim 10 wherein said applicator is mounted for movement transversely relative to said running web.

14. The method of claim 13 wherein said applicator is adapted to be moved transversely to an extent corresponding to substantially one-fourth the width of said web.

* * * * *